United States Patent [19]

Gard et al.

[11] Patent Number: 4,891,641

[45] Date of Patent: Jan. 2, 1990

[54] METHOD FOR TRANSMITTING DATA OVER LOGGING CABLE

[75] Inventors: Michael F. Gard; Donald G. Kyle, both of Plano, Tex.

[73] Assignee: Atlantic Richfield Company, Los Angeles, Calif.

[21] Appl. No.: 291,568

[22] Filed: Dec. 29, 1988

[51] Int. Cl.[4] ..... G01V 1/40

[52] U.S. Cl. ..... 340/857

[58] Field of Search ..... 367/28, 29, 32, 34, 367/81, 82; 340/853, 856, 857, 858, 859; 375/5

[56] References Cited

U.S. PATENT DOCUMENTS 4,035,763 7/1977 Cowles ..... 367/81

4,468,665 8/1984 Thawley et al. ..... 340/856

4,631,536 12/1986 Ward et al. ..... 340/857

4,796,026 1/1989 Hammond ..... 340/857

*Primary Examiner*—Brian S. Steinberger

*Attorney, Agent, or Firm*—Geoffrey A. Mantooth

[57] ABSTRACT

The present invention provides an improved method for transmitting logging data from a logging apparatus operating in a well borehole to surface equipment over a logging cable. The logging data has variations in amplitude, which are converted to a frequency-modulated signal. The center frequency of the frequency-modulated signal is relocated to a lower frequency, which is within the bandwidth of the logging cable. The frequency-modulated signal is transmitted over the logging cable and received by the surface equipment, where the logging data is reconstructed.

9 Claims, 3 Drawing Sheets

METHOD FOR TRANSMITTING DATA OVER LOGGING CABLE

FIELD OF THE INVENTION

The present invention relates to methods for transmitting data over a logging cable, said data being acquired by a logging apparatus operating in a well borehole.

BACKGROUND OF THE INVENTION

Well logging apparatuses are increasingly becoming more and more advanced, thus making it possible to obtain increasingly detailed information on well boreholes and the surrounding formations. As the logging apparatuses become more sophisticated, greater amounts of data are generated.

The logging apparatuses are suspended in well boreholes by logging cables, which provide electrical power and communications channels from the supporting surface equipment to the logging apparatuses. Logging cables have limited bandwidths; a typical short logging cable exhibits a signal bandwidth usable with prior art transmission methods of about 30 KHz. The usable bandwidth of the logging cable is determined by its length and the nature of the logging signal it must carry. The longer the cable the lower the usable bandwidth will be.

With its limited bandwidth, the logging cable forms a bottleneck, reducing the amount of data that can be transmitted uphole to the surface equipment. In systems that transmit analog waveforms over a logging cable, the transmission of faster analog waveforms result in unacceptable amplitude and phase distortion and obliteration of high frequency information. In systems that transmit digital data over a logging cable, the data transfer rate is limited.

Thus, the electrical characteristics of the logging cable limit the system logging speed, measurement resolution, or both.

Prior art methods involving direct amplitude and phase compensation of the logging cable are impractical. Many different types of logging cables are in use and each type has unique electrical characteristics. Compensation is further complicated by the dependance of the electrical characteristics of the logging cable on the length of cable in the borehole and the length of logging cable remaining on the drum. Furthermore, the amount and condition of the logging cable on each logging truck is unique.

SUMMARY OF THE INVENTION

It is an object of the present invention to provide an improved method of transmitting data over a logging cable, which method results in the transmission of greater amounts of data.

Another object of the present invention is to provide a method of transmitting data over a logging cable which has dependable uniform performance independent of the unique logging cable being used.

Another object of the present invention is to provide a method of transmission over a logging cable, which method utilizes commercially available components.

The method of the present invention uses frequency modulation techniques to transmit logging data from a logging apparatus operating in a well borehole to surface equipment over a logging cable. The communications channel in the logging cable has a limited bandwidth which acts as a bottleneck to fast data transmission. The method of the present invention converts the intelligence of logging signals, which is contained in amplitude variations, into frequency changes. Use of frequency modulation techniques increases the effective bandwidth of the logging cable, thereby allowing the transmission of more data uphole than with prior art transmission methods. Furthermore, the method of the present invention makes transmission of data relatively independent of the electrical characteristics of individual logging cables.

In the method of the present invention, the logging apparatus is operated to produce a logging signal for transmission to the surface equipment. The logging signal has variations in amplitude, which variations contain logging information. A carrier waveform with a center frequency is provided and modulated in frequency to contain the logging information. The frequency-modulated signal has an instantaneous frequency that differs from the center frequency by an amount corresponding to the instantaneous amplitude of the logging signal. The instantaneous frequency changes are relocated to a lower frequency range, which is within the bandwidth of the logging cable. The shifted frequency-modulated signal is then transmitted over the logging cable, from the logging apparatus to the surface equipment. On the surface, the transmitted frequency-modulated signal is received and the logging signal is reconstructed by converting the instantaneous frequency changes to instantaneous amplitude changes.

In one aspect, the logging signal is reconstructed by relocating the instantaneous frequency changes to a higher frequency range, which higher frequency range has a center frequency that is substantially similar to the center frequency of the carrier waveform. An amplitude modulated signal containing the logging information is produced. The amplitude modulated signal has an instantaneous amplitude that varies correspondingly to the instantaneous frequency changes of the relocated frequency-modulated signal.

DESCRIPTION OF PREFERRED EMBODIMENT

Figures 1, 2:
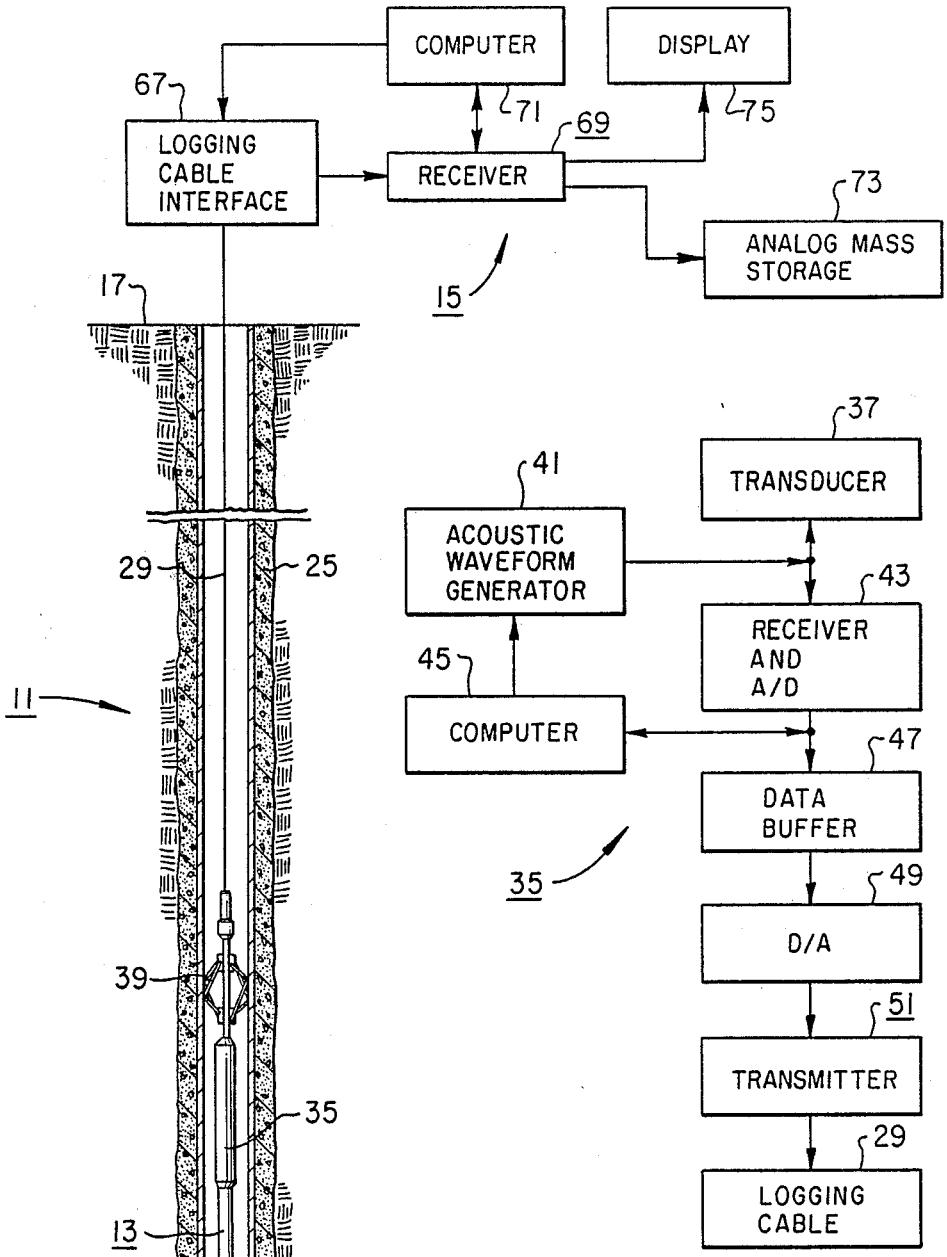
FIG. 1 is a schematic longitudinal cross-sectional view of a well borehole, showing a logging apparatus therein, and supporting surface equipment, with which the method of the present invention, in accordance with a preferred embodiment, can be practiced.
FIG. 2 is a block diagram of the downhole electronics portion of the logging apparatus.

In FIG. 1, there is shown a schematic longitudinal cross-sectional view of a cased well borehole 11, showing an ultrasonic logging apparatus 13 located therein, and supporting surface equipment 15, with which the method of the present invention, in accordance with a preferred embodiment, can be practiced.

The well borehole 11, which is drilled into the earth 17, is for producing oil or natural gas. The well borehole 11 is lined with a length of casing 19. The casing wall has inner and outer surfaces 21, 23. Cement 25 fills the annulus between the casing 19 and the walls of the borehole 11, for at least some of the length of the casing. The cement 25 is used primarily to isolate one formation from another. The interior of the casing is filled with borehole fluids 27, which may be drilling mud, oil, or both.

The logging apparatus 13 is located within the casing 19 and moves up or down the borehole for logging operations. The logging apparatus 13 is suspended inside of the casing by a logging cable 29, which provides electrical power and communication channels from the surface equipment 15. The logging apparatus 13 includes a transducer portion 31 and an electronics portion 35. The transducer portion 31 has an acoustical transducer 37 mounted therein. The transducer 37 is oriented so as to generate acoustic waveforms which are normal to the walls of the casing 19. The logging apparatus is centered along the longitudinal axis of the casing by centralizers 39.

Referring to FIG. 2, the electronics portion 35 includes an acoustic waveform generator 41, a receiver and analog-to-digital (A/D) converter 43, a downhole computer 45, a data buffer 47, a digital-to-analog (D/A) converter 49, and a logging cable transmitter 51. The acoustic waveform generator 41 excites the transducer 37 to generate an acoustic waveform for logging the borehole 11. The resulting acoustic return is received by the transducer 37 and the receiver and A/D converter 43. The receiver portion of the receiver and A/D converter 43 filters and amplifies the acoustic return. The A/D converter portion converts the analog acoustic return into a digital form for downhole processing. The computer 45 may perform some downhole processing of the acoustic return, before the acoustic return is transmitted uphole. The computer 45 also coordinates the production of generated acoustic waveforms and the reception of the acoustic returns. Data is sent uphole over the logging cable 29 with the data buffer 47, the D/A converter 49, and the logging cable transmitter 51. The buffer 47 stores the data for the D/A converter 49, which converts the digital data into analog form. The analog logging data is then sent to the logging cable transmitter 51.

Figure 3:
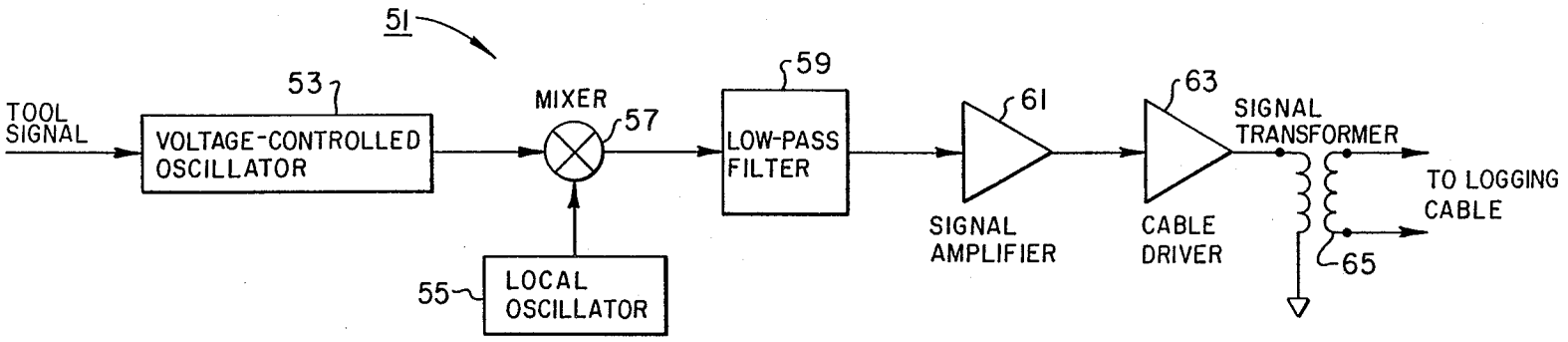
FIG. 3 is a block diagram of the logging cable transmitter portion of the logging apparatus.

The logging cable transmitter 51 transmits the logging data over the logging cable 29 to the surface. The transmitter 51 converts the logging signal (the acoustic return) into a frequency modulated signal for transmission over the logging cable 29. The logging cable transmitter 51, which is shown in FIG. 3, includes a voltage-controlled oscillator 53, a local oscillator 55, a mixer 57, a low-pass filter 59, a signal amplifier 61, a cable driver 63, and a signal transformer 65. The operation of the logging cable transmitter 51 will be described hereinafter.

The logging data on the logging cable 29 is received by the surface equipment 15. The surface equipment includes a logging cable interface 67, a receiver 69, a surface computer 71, an analog mass storage unit 73, and a display 75. The logging cable interface 67 interfaces the receiver 69 and the computer 71 to the logging cable 29. The computer 71 has an operator interface and controls some of the parameters of logging, such as logging speed. The computer 71 may perform some processing of the logging data. The logging data is stored on the analog mass storage unit 73, and displayed on the display 75.

Figure 4:
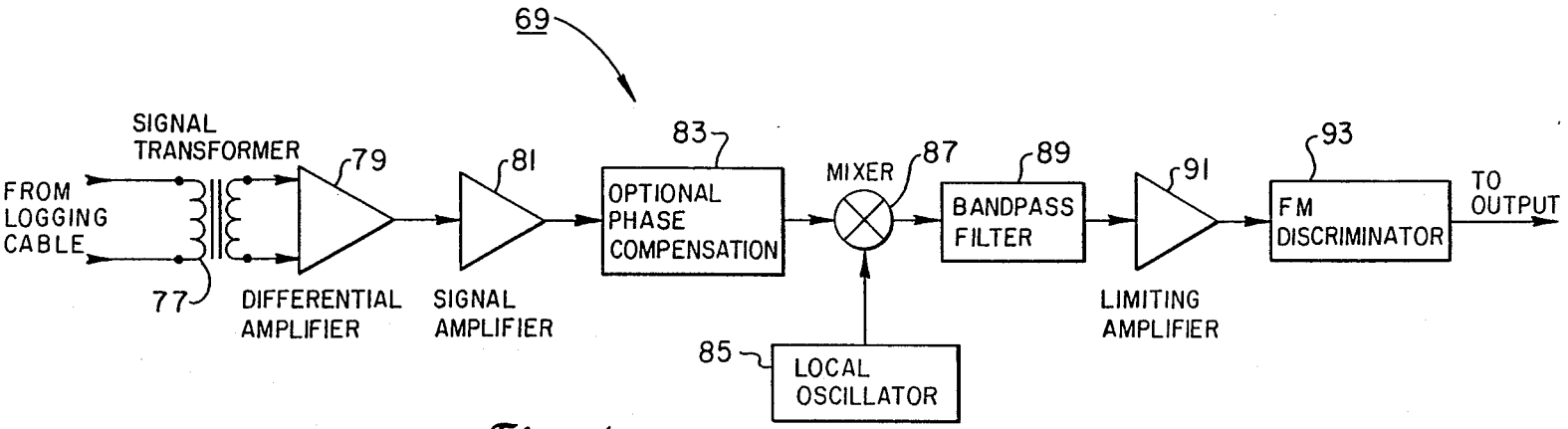
FIG. 4 is a block diagram of the logging cable receiver portion of the surface equipment.

The receiver 69 receives the logging data from the logging cable 29, via the logging cable interface 67. The receiver 69 reconstructs the logging cable signal from the transmitted frequency modulation signal. Referring to FIG. 4, the receiver 69 includes a signal transformer 77, a differential amplifier 79, a signal amplifier 81, a phase compensator 83, a local oscillator 85, a mixer 87, a bandpass filter 89, a limiting amplifier 91, and an FM discriminator 93. The operation of the receiver 69 will be described in more detail hereinafter.

Figure 5:
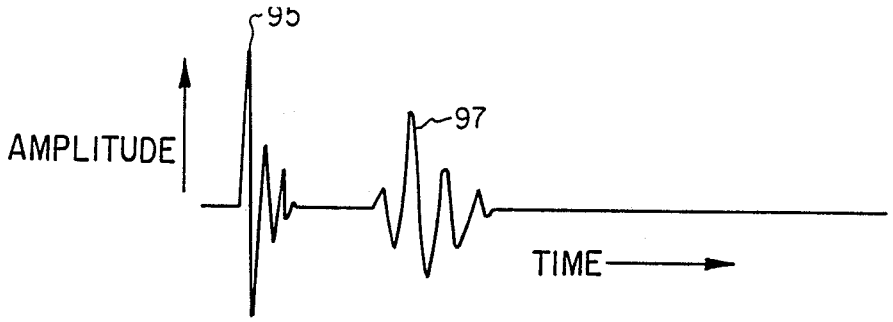
FIG. 5 is a schematic representation of acoustic logging waveforms produced and received by the logging apparatus.

To log the casing 19 in the borehole 11, the logging apparatus 13 is lowered down into the borehole until the desired depth is reached (see FIG. 1). The transducer 37 is periodically excited by the acoustic waveform generator 41 to produce a generated acoustic waveform 95 (see FIG. 5), which is directed to the casing wall 19. The interaction of the generated acoustic waveform 95 with the casing wall produces an acoustic return 97. The acoustic return 97 is received by the transducer 37 and the receiver and A/D converter 43. The logging signal transmitted uphole over the logging cable 29 includes the acoustic return. In acoustical logging, the varying amplitudes of the acoustic return 97 provide information on the condition of the casing 19, and in particular, information on whether the casing is corroded or worn. The acoustic return also provides information on the quality of the bond between the casing 19 and the cement 25. In open, uncased, boreholes, the acoustic return provides information on the formations surrounding the borehole.

The logging signal is transmitted uphole over the logging cable 29. The logging cable 29 has a limited bandwidth. For example, a typical short (e.g. 10,000 feet) logging cable exhibits a signal bandwidth of about 30 KHz using prior art transmission methods. The logging cable 29 exhibits distributed series resistance and inductance as well as shunt capacitance and conductance, which cause the logging cable to act as a distributed low pass filter. Therefore, high frequency signals that are transmitted over long lengths of logging cable are severely attenuated. Measurements on 30,000 feet of a 7/16 inches diameter logging cable resulted in an amplitude attenuation of −40 dbV at 25 KHz, and −80 dbV at 300 KHz.

The method of the present invention increases the effective bandwidth of the logging cable by transmitting logging data utilizing frequency modulation techniques. The logging intelligence of the logging signal is converted from amplitude modulation to frequency modulation. By using the method of the present invention a logging cable signal path with an improved −3dbV bandwidth has been experimentally realized with an FM channel of 50 KHz ±25 KHz, a substantial increase in the effective bandwidth of direct transmission through a long logging cable 29.

Figure 6:
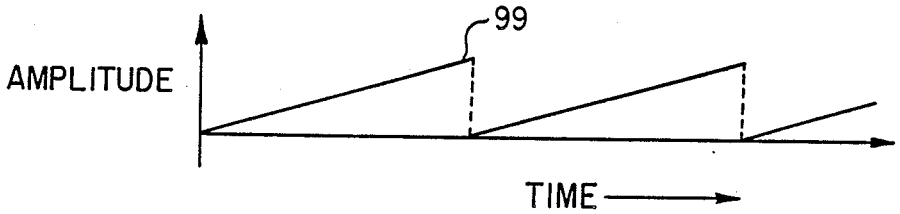
FIG. 6 shows an exemplary modulating waveform.
Figure 7:
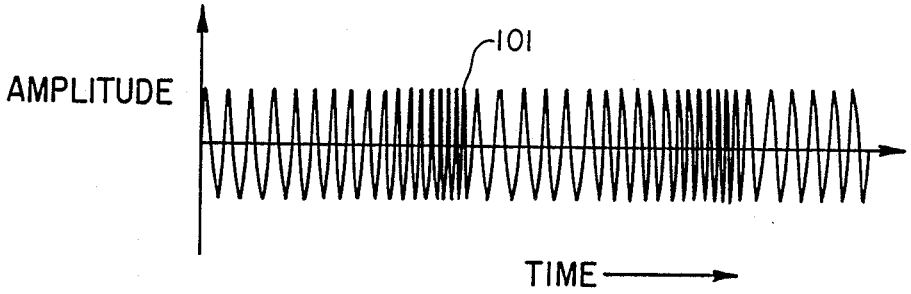
FIG. 7 shows a frequency modulated carrier waveform, resulting from the modulating waveform of FIG. 6.

The operation of the transmitter 51 and the receiver 69 will now be described. The analog logging signal is sent to the transmitter 51 by the D/A converter 49. The analog logging signal enters the voltage-controlled oscillator 53 (see FIG. 4) where the amplitude variations of the logging signal are converted into frequency variations of a carrier waveform. Referring to FIGS. 6 and 7, the variations in amplitude of the logging signal 99 vary the frequency of the oscillator in the voltage-controlled oscillator 53, wherein a frequency modulated sinusoidal signal 101 is produced. (For exemplary purposes in explaining the function of the voltage-controlled oscillator 53, a sawtooth logging signal 99 is shown in FIG. 6.) The instantaneous frequency changes of the frequency-modulated signal correspond to the instantaneous amplitude changes of the logging signal. The voltage-controlled oscillator frequency-modulated signal deviates about a center frequency.

Because the logging cable 29 acts as a low pass filter, the frequency changes are relocated from the higher frequency range, where modulation occurred; to a lower frequency range. Relocation is made necessary because commercially available components (in particular, the voltage-controlled oscillator 53 and the FM discriminator 93) are utilized. Relocation occurs by multiplying the frequency-modulated signal, from the output of the voltage-controlled oscillator 53, with a constant frequency sinusoidal signal, from a local oscillator 55. The signals are multiplied together in the mixer 57, where a signal having two frequency modulated components is produced:

$$\cos(A)\cos(B)=\tfrac{1}{2}[\cos(A+B)]+\tfrac{1}{2}[\cos(A-B)],$$

where A is the center frequency of the frequency-modulated signal and B is the frequency of the local oscillator signal. The resulting mixed signal has a high frequency component $\frac{1}{2}[\cos(A+B)]$ and a low frequency component $\frac{1}{2}[\cos(A-B)]$. The frequency B of the local oscillator signal is selected to advantageously relocate the low frequency component $\frac{1}{2}[\cos(A-B)]$to a center frequency within the available bandwidth of the logging cable. As an example, if the center frequency A of the frequency-modulated signal is 690 KHz with a frequency swing of ± 25 KHz, and the frequency B of the local oscillator signal is 640 KHz, the low frequency component $\frac{1}{2}[\cos(A-B)]$ has a center frequency of 50KHz and a frequency swing of ±25 KHz.

The high frequency component $\frac{1}{2}[\cos(A+B)]$ is filtered out of the frequency-modulated signal by passing the frequency-modulated signal through the low pass filter 59. Then the frequency-modulated signal is amplified by the signal amplifier 61 and the cable driver 63, and transmitted over the logging cable through the signal transformer 65. The signal amplifier 61 provides voltage gain and the cable driver 63 provides current gain for driving the low impedance logging cable 29. The signal transformers 65, 77 impedance match the transmitter and receiver circuits to the logging cable 29.

The receiver 69 receives the frequency-modulated signal from the logging cable 29, through the signal transformer 77. The frequency-modulated signal is amplified by the differential amplifier 79 and the signal amplifier 81. The differential amplifier 79 provides differential gain and common mode noise rejection. The signal amplifier 81 provides the necessary gain. The amplified frequency-modulated signal then goes to the phase compensator 83. The phase compensator 83 is desirable because the logging cable, which acts as a transmission line, introduces non uniform group delay into the frequency-modulated signal. The amount of phase compensation that is applied is empirically determined. The frequency-modulated signal then goes to the mixer 87, where it is combined with a signal from the local oscillator 85 as follows:

$$\tfrac{1}{2}[\cos(A-B)]\cos(B)=\tfrac{1}{4}[\cos(A)]+\tfrac{1}{4}[\cos(A-2B)],$$

where $\frac{1}{2}[\cos(A\text{-}B)]$ is the frequency-modulated signal and B is the frequency of the signal from the local oscillator 85. In the preferred embodiment, the surface local oscillator 85 has the same frequency B as the downhole oscillator 55. By mixing the frequency-modulated signal $\frac{1}{2}[\cos(A-B)]$ with the local oscillator signal, the frequency changes are relocated to their original higher frequency range and to the original center frequency A. The $\frac{1}{4}[\cos(A\text{-}2B)]$ component is filtered out with the bandpass filter 89, leaving just the $\frac{1}{4}[\cos(A)]$component, which is the frequency-modulated signal at its original center frequency A. The relocated and filtered frequency-modulated signal is passed through the limiting amplifier 91, which limits the amplitude of the signal to a predetermined level. The limiting amplifier 91 prevents large amplitude variations in the signal from entering the FM discriminator 93; such amplitude variations would appear as noise to the discriminator. The frequency-modulated signal is input into the FM discriminator 93, which converts the logging intelligence from frequency modulations to amplitude modulations and essentially reconstructs the logging signal. The discriminator 93 is the functional reverse of the voltage-controlled oscillator 53; the discriminator 93 produces an amplitude-modulated signal that contains the logging intelligence. The amplitude-modulated signal has an instantaneous amplitude that varies correspondingly to the instantaneous frequency changes of the relocated frequency-modulated signal. In the preferred embodiment, the discriminator 93 includes an integrator that receives an input at the zero crossing of the frequency-modulated signal.

When selecting the frequency B of the local oscillators 55, 85, it is desired to select the center frequency (A-B) of the transmitted frequency-modulated signal to be as high as permissible, within the limits of the logging cable. Although the frequency swing (for example±25 KHz) is related to the amplitude deviation of the logging signal, how fast the frequency of the frequency-modulated signal deviates is related to how fast the amplitude of the logging signal deviates, which in turn is related to the bandwidth of the logging apparatus. Thus, the higher the center frequency of the transmitted frequency-modulated signal (assuming the frequency deviation is held constant), the higher the permissible bandwidth of the logging apparatus that can be used downhole, and the greater the amount of information that can be generated during logging. Because amplitude modulation is not used, the effective bandwidth of the logging cable 29 can be extended substantially, even though the signal is severely attenuated. As long as the frequency intelligence can be extracted from the transmitted signal, severe attenuation (−40 dbV or more) is permissible.

By transmitting logging intelligence with the method of the present invention, data transmission is made largely independent of the electrical characteristics of individual logging cables.

As an alternative to the use of local oscillators for relocating the center frequency of the transmitted signal, the frequency-modulated signal can be produced by a voltage-controlled oscillator having a center frequency which is within the bandwidth of the logging cable. The selection of the center frequency of the voltage-controlled oscillator is as described above with respect to the selection of the frequency of the local oscillator and the relocated center frequency of the transmitted signal.

Although the method of the present invention has been described in relation to an acoustical logging apparatus, the method of the present invention can be used to transmit other types of logging data over a logging cable.

The foregoing disclosure and the showings made in the drawings are merely illustrative of the principles of this invention and are not to be interpreted in a limiting sense.

We claim:

1. A method of transmitting data over a logging cable, said logging cable connecting a logging apparatus operating in a well borehole to surface equipment, said logging cable providing an electrical Communications channel between said logging apparatus and said surface equipment, said logging cable communications channel having a bandwidth, said cable channel bandwidth having an upper end portion which attenuates signals, comprising the steps of:

(a) operating said logging apparatus to produce a logging signal for transmission to said surface equipment, said logging signal having variations in amplitude which variations contain logging information, said logging signal comprising frequencies that are located within said cable channel bandwidth upper end portion;

(b) providing a carrier waveform, said carrier waveform having a first center frequency;

(c) producing a frequency-modulated waveform to contain said logging information, said frequency-modulated waveform having an instantaneous frequency that differs from the first center frequency by an amount that corresponds to the instantaneous amplitude of said logging signal;

(d) relocating said frequency-modulated waveform to a second center frequency, said second center frequency being located in the upper end portion of said cable channel bandwidth so as to preserve the high frequencies of said logging signal which are within said cable channel bandwidth upper end portion;

(e) transmitting said frequency-modulated waveform over said logging cable from said logging apparatus to said surface equipment;

(f) receiving said frequency-modulated waveform from said logging cable on the surface of said well borehole;

(g) reconstructing said logging signal on the surface by converting said instantaneous frequency changes in said frequency-modulated waveform to instantaneous amplitude changes.

2. The method of claim 1 wherein said logging signal reconstruction on the surface comprises the steps of:

(a) relocating said instantaneous frequency changes of said received frequency-modulated waveform to a third center frequency which is substantially similar to the first center frequency of said carrier waveform;

(b) producing an amplitude-modulated signal to contain said logging information, said amplitude modulated signal having an instantaneous amplitude that varies correspondingly to the instantaneous frequency changes of said relocated frequency-modulated waveform.

3. The method of claim 1 wherein said frequency-modulated waveform is relocated to said second center frequency by mixing said frequency-modulated waveform with a constant frequency reference signal.

4. A method of transmitting data over a logging cable, said logging cable connecting a logging apparatus operating in a well borehole to surface equipment, said logging cable providing an electrical communications channel between said logging apparatus and said surface equipment, said logging cable communications channel having a bandwidth, said cable channel bandwidth having an upper end portion which attenuates signals, comprising the steps of:

(a) operating said logging apparatus to produce a logging signal for transmission to said surface equipment, said logging signal having variations in amplitude which variations contain logging information, said logging signal comprising frequencies that are located within said cable channel bandwidth upper end portion;

(b) producing a frequency-modulated signal that contains said logging information, said frequency modulated signal having an instantaneous frequency that differs from a center frequency by an amount that corresponds to the instantaneous amplitude of said logging signal, with said center frequency of said frequency-modulated signal being located in the upper portion of said cable channel bandwidth so as to preserve the high frequencies of said logging signal that are within said cable channel bandwidth upper end portion;

(c) transmitting said frequency-modulated signal over said logging cable from said logging apparatus to said surface equipment;

(d) receiving said frequency-modulated signal from said logging cable on the surface of said well borehole;

(e) reconstructing said logging signal on the surface by converting said instantaneous frequency changes in said frequency-modulated signal to instantaneous amplitude changes.

5. The method of claim 4 wherein said frequency-modulated signal has a center frequency that is at least 30 KHz.

6. The method of claim 4 wherein said frequency-modulated signal has a center frequency that is at least 50 KHz.

7. The method of claim 4 wherein said frequency-modulated signal is produced by operating a voltage-controlled oscillator to convert said amplitude-modulated logging signal to said frequency-modulated signal.

8. The method of claim 7 wherein said voltage-controlled oscillator produces a frequency-modulated signal having a high center frequency located outside of said cable channel bandwidth, further comprising the step of:

(a) relocating said voltage-controlled-oscillator-produced-frequency-modulated signal to said center frequency which is located within the upper portion of said cable channel bandwidth by mixing said voltage-controlled-oscillator-produced-frequency-modulated signal with a constant frequency sinusoidal signal so as to multiply said voltage-controlled-oscillator-produced-frequency-modulated and said sinusoidal signal together to produce a mixed signal, said mixed signal having a low frequency component and a high frequency component, said low frequency component having for its center frequency said center frequency located within the upper portion of said cable channel bandwidth;

(b) filtering said mixed signal with a low pass filter so as to remove said high frequency component, wherein said low frequency component is transmitted over said cable.

9. The method of claim 8 wherein said logging signal is reconstructed on the surface by relocating said transmitted low frequency component to said high center frequency produced by said voltage-controlled oscillator.

* * * * *